US006500278B1

(12) United States Patent
Abiko

(10) Patent No.: US 6,500,278 B1
(45) Date of Patent: Dec. 31, 2002

(54) HOT ROLLED ELECTRICAL STEEL SHEET EXCELLENT IN MAGNETIC CHARACTERISTICS AND CORROSION RESISTANCE AND METHOD FOR PRODUCTION THEREOF

(75) Inventor: Kenji Abiko, Miyagi (JP)

(73) Assignee: Japan Science and Technology Corporation, Saitama (JP)

( * ) Notice: Subject to any disclaimer, the term of this patent is extended or adjusted under 35 U.S.C. 154(b) by 0 days.

(21) Appl. No.: 09/744,239

(22) PCT Filed: May 26, 2000

(86) PCT No.: PCT/JP00/03398

§ 371 (c)(1),
(2), (4) Date: Jan. 26, 2001

(87) PCT Pub. No.: WO00/73524

PCT Pub. Date: Dec. 7, 2000

(30) Foreign Application Priority Data

May 27, 1999 (JP) ..... 11-148325

(51) Int. Cl.[7] ..... H01F 1/147
(52) U.S. Cl. ..... 148/306; 148/120
(58) Field of Search ..... 148/100, 120–122, 148/306

(56) References Cited

U.S. PATENT DOCUMENTS 3,615,903 A * 10/1971 Perry et al.
5,037,493 A 8/1991 Tomita et al. ..... 148/111
5,037,903 A * 8/1991 Tomita et al. ..... 148/111

FOREIGN PATENT DOCUMENTS

| | | |
|---|---|---|
| JP | 62-77420 | 4/1987 |
| JP | 1-108345 | 4/1989 |
| JP | 2-263920 | 10/1990 |
| JP | 4-224624 | 8/1992 |
| JP | 5-117817 | 5/1993 |
| JP | 5-306437 | 11/1993 |
| JP | 08-27516 | 1/1996 |

OTHER PUBLICATIONS

A Dictionay of Metallurgy, by A. D. Merriman, 1958, p. 339–340.*
English language abstract of JP 62–77420.
English language abstract of JP 08–27516.
English language abstract of JP 02–263920.
English language abstract of JP 05–306437.
English language abstract of JP 05–117817.
English language abstract of JP 01–108345.
English language abstract of JP 04–224624.

* cited by examiner

*Primary Examiner*—John Sheehan
(74) *Attorney, Agent, or Firm*—Greenblum & Bernstein, P.L.C.

(57) ABSTRACT

A hot rolled electromagnetic steel sheet having excellent magnetic properties and corrosion resistance is obtained by heating a super-high purity iron comprising Fe: not less than 99.95 mass %, C+N+S: not more than 10 mass ppm, O: not more than 50 mass ppm and the remainder being inevitable impurity to γ-zone and subjecting in this γ-zone to hot rolling at a total rolling reduction of not less than 50% and under condition that at least one pass is a friction coefficient between roll and rolling material of not more than 0.3 and thereafter cooling at an average cooling rate of 0.5~150° C. over $Ar_3$ transformation point ~300° C.

16 Claims, No Drawings

HOT ROLLED ELECTRICAL STEEL SHEET EXCELLENT IN MAGNETIC CHARACTERISTICS AND CORROSION RESISTANCE AND METHOD FOR PRODUCTION THEREOF

TECHNICAL FIELD

This invention relates to a hot rolled electromagnetic steel sheet, and more particularly to a pure iron based hot rolled electromagnetic steel sheet having excellent magnetic properties by aligning <100> axis in a direction perpendicular to a sheet surface at as-rolled state in a high density and an excellent corrosion resistance and a method of producing the same.

BACKGROUND ART

Silicon steel sheets having excellent electromagnetic properties are used in a core for a transformer or a generator from the old time. As such a silicon steel sheet, there are two kinds of a unidirectional silicon steel sheet utilizing a secondary recrystallization to develop {110}<001> oriented grains or so-called Goss oriented grains, and a non-directional silicon steel sheet developing crystal grains with {100} face parallel to a sheet surface. Among them, the non-directional silicon steel sheets have particularly good properties when magnetic field is applied to various directions in the sheet surface and are frequently used in the generator, electric motor and the like.

In case of producing the non-directional silicon steel sheet used for such applications, it has hitherto been required to conduct decarburization annealing in a controlled atmosphere, cross rolling changing a rolling direction during the cold rolling or the like for gathering {100} face parallel to the sheet surface in a higher density.

For example, JP-A-1-108345 relating to silicon steel containing Si: 0.2~6.5 wt % or JP-A-4-224624 relating to steel containing Al+Si: 0.2~6.5 wt % discloses a technique that the steel is cold-rolled and annealed in a weak decarburizing atmosphere, for example, under vacuum of not more than 0.1 torr or in an atmosphere having a dew point of not more than 0° C. and composed of one or more of $H_2$, He, Ne, Nr, Ar, Xe, Rn and $N_2$ to form α-single phase region in a zone corresponding to a depth of 5~50 μm from the sheet surface and then annealed in a strong decarburizing atmosphere, for example, $H_2$ having a dew point of not less than −20° C. or a gas obtained by adding an inert gas or CO, CO2 to $H_2$ having a dew point of not less than −20° C. at 650~900° C. for 5~20 minutes to grow the α-single phase region formed on the surface layer portion into the inside in the thickness direction to thereby improve the magnetic properties.

Thus, complicated steps inclusive the decarburization annealing have be required in addition to the hot rolling—cold rolling steps for gathering the {100} face parallel to the sheet surface in a high density from the old time. And also, the conventional electromagnetic steel sheets including 3% Si steel are low in the corrosion resistance, so that an insulating film having an excellent corrosion resistance is applied onto a final product, which is a factor raising the product cost.

However, it is recently demanded to have high performances in a cheaper cost with the popularization of electrical goods, which is impossible to cope with the aforementioned conventional technique. Although it is considered to more simplify the production steps for satisfying the above demand, the conventional technique is difficult to enhance the gathering of {100} orientation parallel to the sheet surface as hot-rolled.

It is, therefore, an object of the invention to propose a hot rolled electromagnetic steel sheet having improved magnetic properties and corrosion resistance by gathering the {100} orientation parallel to the sheet surface at a time of completing hot rolling and a method of producing the same.

DISCLOSURE OF INVENTION

The inventors have made various studies for solving the above problems in the hot rolled electromagnetic steel sheet and found that the formation of {100} orientation parallel to sheet surface, i.e. <100>//ND orientation of the steel sheet (direction perpendicular to sheet surface) is promoted by highly purifying steel to form a pure iron based component composition and rationalizing hot rolling conditions (particularly rolling reduction at given temperature region, friction coefficient) and cooling rate at α-zone after hot rolling, and as a result the invention has been accomplished.

That is, the invention is a hot rolled electromagnetic steel sheet consisting of a super-high purity iron comprising Fe: not less than 99.95 mass %, C+N+S: not more than 10 mass ppm, O: not more than 50 mass ppm and the remainder being inevitable impurity, and having excellent magnetic properties and corrosion resistance.

As a method of producing the above hot rolled electromagnetic steel sheet, the invention also proposes a method of producing a hot rolled electromagnetic steel sheet having excellent magnetic properties and corrosion resistance, characterized in that a super-high purity iron comprising Fe: not less than 99.95 mass %, C+N+S: not more than 10 mass ppm, O: not more than 50 mass ppm and the remainder being inevitable impurity is heated to γ-zone and subjected in this γ-zone to hot rolling at a total rolling reduction of not less than 50% and under condition that at least one pass is a friction coefficient between roll and rolling material of not more than 0.3 and thereafter cooled at an average cooling rate of 0.5~150° C. over $Ar_3$ transformation point ~300° C.

As a preferable method, the invention proposes a method of producing a hot rolled electromagnetic steel sheet having excellent magnetic properties and corrosion resistance, characterized in that a super-high purity iron comprising Fe: not less than 99.95 mass %, C+N+S: not more than 10 mass ppm, O: not more than 50 mass ppm and the remainder being inevitable impurity is heated to γ-zone and subjected in this γ-zone to hot rolling at a total rolling reduction of not less than 50% and under condition that at least one pass is a friction coefficient between roll and rolling material of not more than 0.3 and a strain rate of not less than 150 l/second and thereafter cooled at an average cooling rate of 0.5~150° C. over $Ar_3$ transformation point ~300° C.

BEST MODE FOR CARRYING OUT THE INVENTION

An embodiment of the invention will be described below.

At first, the reason on the limitation of chemical composition in the pure iron based electromagnetic steel sheet according to the invention is described.

Fe: Not Less than 99.95 mass %

A raw material of high purity Fe is hot rolled in γ-zone and then cooled in α-zone, during which <100>//ND oriented grains grow. The purity of Fe is particularly important in the invention. When the purity is less than 99.95 mass %, the <100>//ND oriented grains hardly grow in the cooling.

Therefore, Fe is not less than 99.95 mass %, preferably not less than 99.98 mass %.

C+N+S: Not More than 10 Mass ppm, O: Not More than 50 mass ppm

These gas components in the pure iron form carbide, oxide and the like with metallic elements (Al, Ti, Nb, Mn and the like) contained at extremely slight amounts of few~few tens mass ppm in the pure iron to obstruct occurrence and growth of nucleus for <100>//ND oriented grains. And also, the corrosion of pure iron based material is mainly caused by starting from C, N, S segregated in a grain boundary or oxides existing in the grain boundary or in the grains to create rust.

Such a bad influence of C, N, S and O appears even when C+N+S exceeds 10 mass ppm or even when O exceeds 50 mass ppm, so that it is necessary to satisfy C+N+S: not more than 10 mass ppm and O: not more than 50 mass ppm together. Moreover, preferable content ranges are C+N+S: not more than 5 mass ppm and O: not more than 20 mass ppm.

Then, production conditions of the pure iron based electromagnetic steel sheet according to the invention are described.

Hot Rolling

When the raw material of pure iron based steel having the above component composition is hot rolled in α-zone, crystal grains are fined and <100>//ND oriented grains do not quite grow. Therefore, the hot rolling is necessary to be carried out at a temperature of γ-zone. When friction coefficient between roll and raw material exceeds 0.3 in the rolling of γ-zone, <110>//ND oriented grains are apt to be easily generated at a position near to 1/10 of the sheet thickness and hence the occurrence and growth of <100>//ND oriented grains are controlled. For this end, the hot rolling is carried out at he fiction coefficient of not more than 0.3, preferably not more than 0.2. When the rolling under such a condition (so-called lubrication rolling) is conducted in at least one pass of the hot rolling, the effect is developed. Particularly, when it is conducted in a final pass, a more larger effect is developed because shearing strain does not concentrate in the surface layer of the steel sheet before transformation. Furthermore, when the strain rate of the rolling is made not less than 150 l/second in the lubrication rolling, the formation of <100>//ND oriented grains is promoted. Such a tendency is considered due to the fact that the formation of oriented grains other than <100>//ND such as <110>//ND easily formed on the surface layer portion of the steel sheet or the like is controlled. Moreover, when the strain rate is made not less than 200 l/second, a further larger effect is obtained.

In the above hot rolling in the γ-zone, the total rolling reduction is required to be not less than 50%. Because, when the total rolling reduction in the hot rolling of γ-zone is not less than 50%, the recrystallization in the hot rolling is promoted to fine γ-grain size and the <100>//ND oriented grains are preferentially grown in a direction of sheet thickness in the cooling course after γ→α transformation. When the total rolling reduction is less than 50%, equiaxed crystal grains having a random direction remain in a central portion of the sheet thickness to degrade the magnetic properties.

Cooling After Hot Rolling

The <100>//ND oriented grains in the super-high purity iron grow from the surface of the steel sheet toward a center thereof at α-zone after γ→α transformation while eroding α-grains newly created through transformation. In this case, when the cooling rate over $Ar_3$~300° C. exceeds 150° C./min, the grain growing rate does not follow to the cooling rate and equiaxed grains remain in the central portion of the sheet thickness. On the other hand, when the cooling rate is slower than 0.5° C./min, the <100>//ND oriented grains are coarsened to rather bring about the degradation of the magnetic properties. Therefore, the cooling rate within a temperature range of $Ar_3$~300° C. after the rolling is required to be 0.5~150° C./min. Moreover, the preferable cooling rate is 1.0~100° C./min.

As mentioned above, according to the invention, the effect is first developed by using the pure iron based steel as a raw material and carrying out the production under given conditions, but if any one of the conditions is not satisfied, the gathering degree of <100>//ND oriented grains can not be enhanced. Moreover, the corrosion resistance is not substantially affected by the production conditions and is dependent upon the component composition.

EXAMPLE

The invention is concretely described with respect to examples.

A pure iron based steel having a chemical composition shown in Table 1 is melted in a melting furnace of super-high vacuum ($10^{-8}$ Torr) provided with a water-cooled type copper crucible to form an ingot of 10 kg. The ingot is hot forged in γ-zone to form a rod-shaped raw material of 25 mm in thickness. The rod-shaped raw material is heated to 1100° C. and hot rolled to a sheet thickness of 1 mm (partly thickness of 5 mm and 13 mm). In this case, the hot rolling is carried out by changing friction coefficient between roll and the raw material, strain rate and the like in the final pass. Further, the cooling rate after the rolling is varied within a wide range. These production conditions are shown in Table 2.

TABLE 1

| Steel | Fe/ mass % | C/ mass ppm | N/ mass ppm | S/ mass ppm | C + N + S/ mass ppm | O/ mass ppm | $Ar_3$ transformation point (° C.) | Remarks |
|---|---|---|---|---|---|---|---|---|
| A | 99.99 | 0.2 | 0.5 | 1.2 | 1.9 | 21 | 908 | Example |
| B | 99.98 | 1.1 | 1.3 | 1.7 | 4.1 | 18 | 905 | Example |
| C | 99.96 | 2.1 | 1.9 | 4.3 | 8.3 | 33 | 900 | Example |
| D | 99.97 | 8.4 | 9.2 | 12.1 | 29.7 | 28 | 898 | Comparative Example |
| E | 99.96 | 3.1 | 2.7 | 4.1 | 9.9 | 80 | 900 | Comparative Example |

TABLE 1-continued

| Steel | Fe/ mass % | C/ mass ppm | N/ mass ppm | S/ mass ppm | C + N + S/ mass ppm | O/ mass ppm | $Ar_3$ transformation point (° C.) | Remarks |
|---|---|---|---|---|---|---|---|---|
| F | 99.91 | 4.2 | 2.3 | 3.1 | 9.6 | 16 | 895 | Comparative Example |

TABLE 2

| No | Steel | Final pass of hot rolling: Temperature of hot rolling (° C.) | Final pass of hot rolling: Friction coefficient | Final pass of hot rolling: Strain rate (1/second) | Total rolling reduction of hot rolling (%) | Finishing sheet thickness (mm) | Cooling rate over $Ar_3$ ~300° C. (° C./minute) | Diffraction rate of X-ray $I_{100}/I_0$ | Magnetic flux density B50 (T) | Iron loss W15/50 (W/kg) | Corrosion loss (g/m$^2$) | Remarks |
|---|---|---|---|---|---|---|---|---|---|---|---|---|
| 1 | A | 930 | 0.1 | 250 | 96 | 1.0 | 20 | 53 | 1.78 | 1.5 | 0.55 | Example |
| 2 | A | 930 | 0.3 | 210 | 95 | 1.0 | 70 | 49 | 1.77 | 1.6 | 0.51 | Example |
| 3 | A | 910 | 0.1 | 320 | 96 | 1.0 | 1.5 | 61 | 1.79 | 1.4 | 0.45 | Example |
| 4 | A | 850 | 0.2 | 180 | 96 | 1.0 | 20 | 1.1 | 1.55 | 3.3 | 0.87 | Comparative Example |
| 5 | A | 910 | nolubrication (0.6) | 180 | 96 | 1.0 | 20 | 1.6 | 1.55 | 3.4 | 0.96 | Comparative Example |
| 6 | B | 920 | 0.2 | 210 | 96 | 1.0 | 40 | 45 | 1.76 | 1.7 | 0.68 | Example |
| 7 | B | 940 | 0.2 | 160 | 48 | 13.0 | 80 | 1.2 | 1.52 | 3.6 | 0.98 | Comparative Example |
| 8 | C | 920 | 0.1 | 260 | 96 | 1.0 | 90 | 40 | 1.75 | 1.7 | 0.79 | Example |
| 9 | C | 920 | 0.2 | 260 | 96 | 1.0 | 0.3 | 13 | 1.68 | 2.1 | 0.98 | Comparative Example |
| 10 | C | 940 | 0.2 | 210 | 80 | 5.0 | 40 | 21 | 1.75 | 1.8 | 0.98 | Example |
| 11 | D | 920 | 0.2 | 240 | 96 | 1.0 | 50 | 1.3 | 1.38 | 8.5 | 21.4 | Comparative Example |
| 12 | E | 920 | 0.1 | 260 | 96 | 1.0 | 50 | 3.4 | 1.60 | 2.9 | 14.2 | Comparative Example |
| 13 | F | 930 | 0.3 | 260 | 96 | 1.0 | 50 | 1.2 | 1.53 | 3.5 | 36.2 | Comparative Example |

The texture of the resulting hot rolled sheet is measured at a position corresponding to ¼ of the sheet thickness by an x-ray. And also, a test piece of 1.0 mm in thickness is cut out from a central portion of the thickness of the hot rolled sheet and then a ring-shaped specimen having an inner diameter of 50 mm and an outer diameter of 60 mm is punched out therefrom and thereafter a primary coil and a secondary coil are wound on the specimen every 100 turns to measure magnetic properties. As the magnetic properties, there are adopted a magnetic flux density (B50) when an external magnetic field of 5000 A/m is applied and an iron loss (W15/50) when it is magnetized to 1.5 T in an alternating magnetic field of 50 Hz.

The corrosion resistance is evaluated by immersing in aqua regia of 20° C. (mixed solution of concentrated nitric acid and concentrated hydrochloric acid at a volume ratio of 1:3) for 100 seconds to measure corrosion rate. It can be said that when the corrosion rate is not more than 1.0 g/m2, the corrosion resistance is satisfactory under usual use environment.

The test results are also shown in Table 2. As seen from Table 2, the invention examples are excellent in both the magnetic properties and corrosion resistance. On the contrary, the comparative examples are largely poor in at least one of the magnetic properties and the corrosion resistance as compared with the invention examples.

Industrial Applicability

As mentioned above, according to the invention, it is possible to gather {100} orientation parallel to the sheet surface after the completion of the hot rolling without passing through complicated steps such as decarburization annealing after cold rolling and the like, so that it is possible to cheaply provide hot rolled electromagnetic steel sheets having excellent magnetic properties.

What is claimed is:

1. A hot rolled electromagnetic steel sheet comprising a super-high purity iron comprising at least 99.95 mass % Fe, at most 10 mass ppm C+N+S, at most 50 mass ppm O, and the remainder comprising impurity, the sheet having excellent magnetic properties and corrosion resistance.

2. The hot rolled electromagnetic steel sheet of claim 1 further comprising at least 99.98 mass % Fe.

3. The hot rolled electromagnetic steel sheet of claim 1 further comprising at most 5 mass ppm C+N+S and at most 20 mass ppm O.

4. The hot rolled electromagnetic steel sheet of claim 2 further comprising at most 5 mass ppm C+N+S and at most 20 mass ppm O.

5. The hot rolled electromagnetic steel sheet of claim 1 further comprising a corrosion rate in 20° C. aqua regia of at most 1 g/m$^2$.

6. The hot rolled electromagnetic steel sheet of claim 1 further comprising an iron loss (W15/50) of not more than 1.8 W/kg when magnetized to 1.5 T in a 50 Hz alternating magnetic field.

7. The hot rolled electromagnetic steel sheet of claim 1 further comprising a magnetic flux density (B50) of not less than 1.75 T in an external magnetic field of 5000 A/m.

8. A core for a transformer or generator comprising components derived from the hot rolled electromagnetic steel sheet of claim 1.

9. The hot rolled electromagnetic steel sheet of claim 1, which is at most 5 mm thick.

10. A method of producing a hot rolled electromagnetic steel sheet having excellent magnetic properties and corrosion resistance comprising:

heating a super-high purity iron material comprising not less than 99.95 mass % Fe, not more than 10 mass ppm C+N+S, not more than 50 mass ppm O, and the remainder comprising impurity, to γ-zone;

subjecting the material to hot rolling in the γ-zone to a total rolling reduction of at least 50%, wherein at least one rolling pass is carried out with a friction coefficient between a roll and the material of at most 0.3; and cooling the material over a temperature range from the $Ar_3$ transformation point to 300° C. at an average cooling rate of 0.5 to 150° C./min.

11. The method of claim 10, wherein the friction coefficient is at most 0.2.

12. The method of claim 10, wherein at least one rolling pass is carried out with strain rate of at least 150 l/sec.

13. The method of claim 10, wherein at least one rolling pass is carried out with strain rate of at least 200 l/sec.

14. The method of claim 10, wherein the cooling rate is 1 to 100° C./min.

15. The method of claim 10, wherein iron material comprises at least 99.98 mass % Fe.

16. The method of claim 10, wherein iron material comprises at most 5 mass ppm C+N+S and at most 20 mass ppm O.

* * * * *